US010547135B2

(12) United States Patent
Sugiura

(10) Patent No.: US 10,547,135 B2
(45) Date of Patent: Jan. 28, 2020

(54) SPRING CONNECTOR

(71) Applicant: YOKOWO CO., LTD., Kita-ku, Tokyo (JP)

(72) Inventor: Kenta Sugiura, Tomioka (JP)

(73) Assignee: YOKOWO CO., LTD., Kita-ku, Tokyo (JP)

( * ) Notice: Subject to any disclaimer, the term of this patent is extended or adjusted under 35 U.S.C. 154(b) by 0 days.

(21) Appl. No.: 16/080,796

(22) PCT Filed: Feb. 10, 2017

(86) PCT No.: PCT/JP2017/005022
§ 371 (c)(1),
(2) Date: Aug. 29, 2018

(87) PCT Pub. No.: WO2017/159155
PCT Pub. Date: Sep. 21, 2017

(65) Prior Publication Data

US 2019/0067859 A1 Feb. 28, 2019

(30) Foreign Application Priority Data

Mar. 18, 2016 (JP) ..... 2016-055615

(51) Int. Cl.
*H01R 12/00* (2006.01)
*H01R 13/24* (2006.01)
(Continued)

(52) U.S. Cl.
CPC ..... *H01R 13/2421* (2013.01); *H01R 11/01* (2013.01); *H01R 13/52* (2013.01)

(58) Field of Classification Search
CPC ..... H01R 23/722; H01R 9/097; H01R 12/57; H01R 13/6315; H01R 13/187
(Continued)

(56) References Cited

U.S. PATENT DOCUMENTS 5,174,763 A * 12/1992 Wilson ..... G01R 1/07328 439/245
5,982,187 A * 11/1999 Tarzwell ..... G01R 1/06722 324/72.5
(Continued)

FOREIGN PATENT DOCUMENTS

CN 2484674 Y 4/2002
CN 101145653 A 3/2008
(Continued)

OTHER PUBLICATIONS

Search Report (with partial translation) and Written Opinion dated Mar. 7, 2017, issued in corresponding International Application No. PCT/JP2017/005022.
(Continued)

*Primary Examiner* — Phuong Chi Thi Nguyen
(74) *Attorney, Agent, or Firm* — Morgan, Lewis & Bockius LLP

(57) ABSTRACT

Provided is a spring connector capable of preventing deformation of a waterproof elastic member from being spread to a periphery. A spring connector includes a first pin having a contact part with an object, a spring for applying a contact force with the object to the first pin, an intermediate member held by the first pin so as to move together with the first pin by pressing-in or the like, and a waterproof elastic member which is interposed between the first pin and the intermediate member and watertightly seals a space between the first pin and the intermediate member.

13 Claims, 9 Drawing Sheets

(51) Int. Cl.
*H01R 11/01* (2006.01)
*H01R 13/52* (2006.01)

(58) Field of Classification Search
USPC ..... 439/66, 75, 81, 248, 481, 591, 840
See application file for complete search history.

(56) References Cited

U.S. PATENT DOCUMENTS

| | | | | |
|---|---|---|---|---|
| 6,462,567 | B1 * | 10/2002 | Vinther | G01R 1/06722 324/754.14 |
| 6,491,527 | B1 * | 12/2002 | Smith | H01R 13/2421 439/66 |
| 6,638,097 | B2 * | 10/2003 | Wu | H01R 11/18 439/482 |
| 2014/0220801 | A1 | 8/2014 | Shimizu | |
| 2014/0273658 | A1 | 9/2014 | Ackins | |
| 2014/0377986 | A1 | 12/2014 | Endo et al. | |

FOREIGN PATENT DOCUMENTS

| | | | |
|---|---|---|---|
| CN | 201149917 | Y | 11/2008 |
| CN | 201149927 | Y | 11/2008 |
| CN | 201515022 | U | 6/2010 |
| CN | 201570712 | U | 9/2010 |
| CN | 103441373 | A | 12/2013 |
| CN | 103875133 | A | 6/2014 |
| CN | 104054221 | A | 9/2014 |
| CN | 105655789 | A | 6/2016 |
| JP | H07-296882 | A | 11/1995 |
| JP | 3254545 | B2 | 2/2002 |
| JP | 2007-173073 | A | 7/2007 |
| JP | 2013-145706 | A | 7/2013 |
| JP | 2014-192118 | A | 10/2014 |

OTHER PUBLICATIONS

The World Intellectual Property Organization (WIPO) International Search Report for PCT/CN2016/087038 dated Dec. 13, 2016 6 Pages.

Office Action issued in corresponding Chinese Patent Application No. 201780014294.5 dated Aug. 30, 2019.

Office Action dated Oct. 16, 2019, issued in corresponding Taiwanese Patent Application No. 106108927.

* cited by examiner

1 SPRING CONNECTOR

1 SPRING CONNECTOR

2 SPRING CONNECTOR

3 SPRING CONNECTOR

4 SPRING CONNECTOR

5 SPRING CONNECTOR

SPRING CONNECTOR

TECHNICAL FIELD

The present invention relates to a spring connector which is applied, for example, to electrically connecting mobile communication equipment such as a smartphone or a business-use radio terminal as one object to a cradle or the like used for the equipment as another object, particularly, to a spring connector having a structure for preventing intrusion of water drops.

BACKGROUND ART

As a structure for securing waterproof properties in a spring connector, what is known is a structure in which a side surface of a conductive tube having a larger diameter than that of a through-hole provided in an elastic member such as rubber tightly contacts with the through-hole (Patent Document 1).

PRIOR ART DOCUMENT

Patent Document

[Patent Document 1]: JP-A-2013-145706

SUMMARY OF THE INVENTION

Problem to be Solved by the Invention

In the structure described in Patent Document 1, since the waterproof properties are secured by expanding the through-hole provided in the elastic member with a single part, a deformation of the elastic member due to the expansion of the through-hole is easily spread to a periphery and it is difficult to accurately determine a position of a pin to be a contact part or a distance between adjacent pins.

The present invention has been made by considering such a circumstance, and an object thereof is to provide a spring connector capable of preventing a deformation of a waterproof elastic member from being spread to a periphery.

Means for Solving the Problem

An aspect of the present invention is a spring connector. The spring connector includes:

a first pin having a contact part with an object;

a spring for applying a contact force with the object to the first pin;

an intermediate member electrically connected to the first pin and fixed to the first pin; and a waterproof elastic member which is interposed between the first pin and the intermediate member and watertightly seals a space between the first pin and the intermediate member.

One of the first pin and the intermediate member may have a hole opening to a side of the other of the first pin and the intermediate member, and the other of the first pin and the intermediate member may have a rod-shaped part extending into the hole, and the waterproof elastic member may have a cylindrical part positioned in the hole and the cylindrical part may be interposed between an inner surface of the hole and an outer surface of the rod-shaped part.

The rod-shaped part may have a convex part which is provided in the outer surface and presses the waterproof elastic member.

The convex part may have a tapered part having an outer diameter which becomes smaller toward a bottom side of the hole.

The rod-shaped part may have a concave part provided in the outer surface at a position closer to an opening side of the hole than the convex part, and the waterproof elastic member deformed by pressing of the convex part may extend into the concave part.

The hole may have a narrow part which is narrowed in an external dimension and presses the waterproof elastic member.

The spring connector may further include a second pin having a contact part with another object, the spring may urge the first pin and the second pin in a direction in which the first pin and the second pin are separated from each other, and the intermediate member may be a tube for accommodating the spring, a part of the first pin, and a part of the second pin.

One of the first pin and the intermediate member may have a hole opening to a side of the other of the first pin and the intermediate member, and the other of the first pin and the intermediate member may have a rod-shaped part pressed into the hole.

The first pin may be a member made of a sheet metal and may have a leaf spring part, and the intermediate member may have a concave part engaged with the leaf spring part.

Surfaces of the first pin and the intermediate member may be respectively subjected to plating, and the plating on the surface of the intermediate member may be thinner than the plating on the surface of the first pin.

The waterproof elastic member may have a first surface part through which the first pin or the intermediate member penetrates, and a side surface part extending from the first surface part to a side opposite to a tip of the first pin.

The spring connector may further include a housing having a through-hole for accommodating at least a part of either one or both of the spring and the intermediate member, and a cover covering the housing and having a through-hole through which the first pin penetrates, and a space may be present between the housing and the cover, and the side surface part of the waterproof elastic member may be capable of bending within the space.

The waterproof elastic member may have a second surface part extending so as to be broadened from the side surface part in a position on a side opposite to the first surface part, and the second surface part may be pressed over the entire circumference surrounding the periphery of the through-hole of the housing by the housing and the cover.

Any combination of the above constituent elements and an aspect obtained by changing an expression of the present invention in terms of a method, a system, or the like are also effective as an aspect of the present invention.

EFFECTS OF THE INVENTION

According to the present invention, it is possible to provide a spring connector capable of preventing a deformation of a waterproof elastic member from being spread to a periphery.

DESCRIPTION OF EMBODIMENTS

Figure 1:
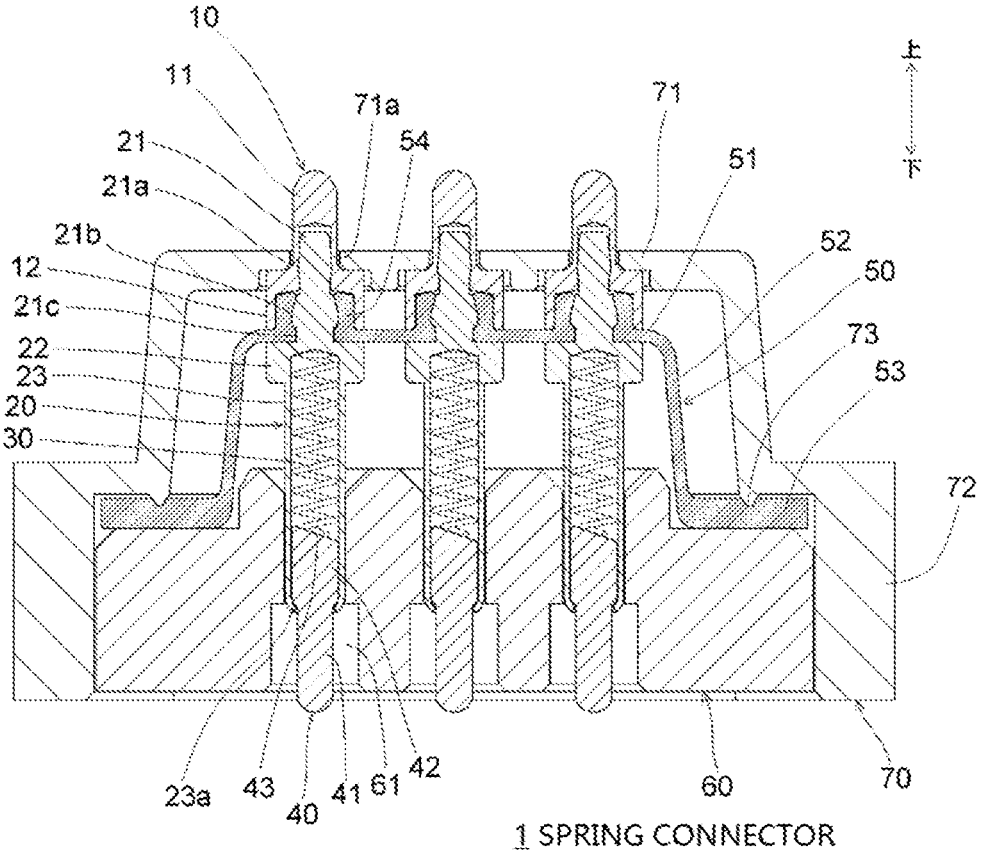
FIG. 1 is a cross-sectional view illustrating a state where a spring connector 1 according to a first embodiment of the present invention is not used.

Hereinafter, preferred embodiments of the present invention will be described in detail with reference to the drawings. The same reference numerals are added to the same or equivalent constituent elements, members, or the like shown in the drawings, and repeated description will be omitted as appropriate. In addition, the embodiments do not limit the invention and is merely an example, and all features or combinations thereof described in the embodiments are not necessarily essential to the invention.

First Embodiment

With reference to FIGS. 1 to 5, a spring connector 1 according to a first embodiment of the present invention will be described. In FIG. 1, a vertical direction of the spring connector 1 is defined. The spring connector 1 includes a first pin 10, an intermediate member 20, a spring 30, a second pin 40, a waterproof elastic member 50, a housing 60, and a cover 70. In the spring connector 1, a number of contact unit including the first pin 10, the intermediate member 20, the spring 30, and the second pin 40 may be one, or may be any arbitrary numbers which are two or more.

Figure 2A:
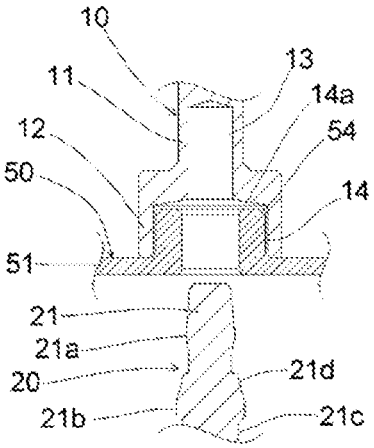
FIGS. 2(A) to 2(C) are cross-sectional views partially illustrating an assembly process of the spring connector 1 by enlarging main parts.
Figure 5:
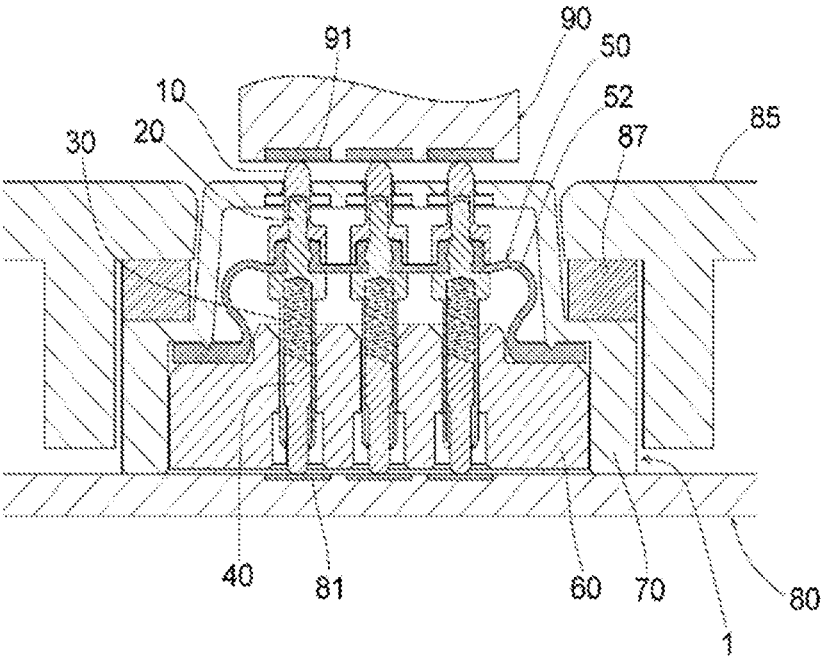
FIG. 5 is a cross-sectional view which illustrates an example of a use form of the spring connector 1, and illustrates a state where a substrate 80 and a terminal 90 of an object device are electrically connected to each other by the spring connector 1.

The first pin 10 is a conductive metallic body such as copper or a copper alloy. A tip of the first pin 10 is a contact part with an electrode 91 of a terminal 90 which is one object (FIG. 5). The first pin 10 has a small-diameter part 11 having a contact part in contact with the electrode 91 and having a small diameter, and a large-diameter part 12 having a larger diameter than that of the small-diameter part, in order from an upper side (a tip side of the first pin 10). A step surface (an upper surface of the large-diameter part 12) between the small-diameter part 11 and the large-diameter part 12 comes into contact with an inner side of a ceiling part 71 of the cover 70, and thus the first pin 10 is prevented from pulling out from the cover 70. The first pin 10 has a hollow structure in which a base end of the large-diameter part 12 is opened. As illustrated in FIG. 2(A), the hollow structure has a small-diameter hole 13 and a large-diameter hole 14 which are concentric with each other. The small-diameter hole 13 and the large-diameter hole 14 are formed so as to approximately correspond to the positions of the small-diameter part 11 and the large-diameter part 12. The large-diameter hole 14 is opened to the base end of the large-diameter part 12. The small-diameter hole 13 is opened to a central part on an upper surface of the large-diameter hole 14. The small-diameter hole 13 is a hole for pressing-in a rod-shaped part 21 of the intermediate member 20. The large-diameter hole 14 is a hole for accommodating a cylindrical part 54 of the waterproof elastic member 50. As illustrated in FIG. 2(A), in a state before the rod-shaped part 21 of the intermediate member 20 is pressed into the small-diameter hole 13, that is, a state before the cylindrical part 54 of the waterproof elastic member 50 is deformed, a gap 14*a* is present between the cylindrical part 54 accommodated in the large-diameter hole 14 and the upper surface of the large-diameter hole 14. The gap 14*a* is provided as a space for releasing the cylindrical part 54 deformed as illustrated in FIG. 2(C).

The intermediate member 20 is a conductive metallic body such as copper or a copper alloy. The intermediate member 20 interposes the waterproof elastic member 50 together with the first pin 10, as described below. The intermediate member 20 has the rod-shaped part 21, a flange part 22, and a cylindrical part 23, in order from an upper side. As illustrated in FIG. 2(C), the rod-shaped part 21 extends into the small-diameter hole 13 and the large-diameter hole 14 of the first pin 10. The rod-shaped part 21 is pressed into the small-diameter hole 13 of the first pin 10, and thus the intermediate member 20 is fixed to the first pin 10 and can be operated together (integrally) with the first pin 10. Moreover, the rod-shaped part 21 is pressed into the small-diameter hole 13, and thus the intermediate member 20 is reliably electrically connected to the first pin 10. The rod-shaped part 21 has a press-in part 21*a*, a convex part 21*b*, and a concave part 21*c*.

The press-in part 21*a* has a slightly larger diameter than an inner diameter of the small-diameter hole 13 of the first pin 10, and generates a holding force by pressing-in in a space between an inner surface of the small-diameter hole 13 and the press-in part 21*a*. The convex part 21*b* is a protruded strip (a pressing part) extending one round around an outer surface of the rod-shaped part 21, and is positioned below the press-in part 21*a*. The convex part 21*b* presses the cylindrical part 54 of the waterproof elastic member 50 toward the inner side of the large-diameter hole 14 of the first pin 10. As illustrated in FIG. 2(C), the convex part 21*b* has a tapered part 21*d*. An outer diameter of the tapered part 21*d* becomes smaller from a lower side toward an upper side (front an opening side which is an opening end side to a bottom side which is the small-diameter hole 13 side of the large-diameter hole 14 of the first pin 10). In the tapered part 21*d*, an outer diameter of an upper part is smaller than an inner diameter of a through-hole 55 of the cylindrical part 54 of the waterproof elastic member 50 in a non-compression state, and an outer diameter of a lower part is larger than the inner diameter of the through-hole 55 of the cylindrical part 54. The tapered part 21*d* has a function that the convex part 21*b* does not damage a lower end part of the cylindrical part 54 of the waterproof elastic member 50 and the convex part 21*b* is easy to be inserted into the through-hole 55, when the rod-shaped part 21 is pressed into the small-diameter hole 13 of the first pin 10 (FIG. 2(B) to FIG. 2(C)). The concave part 21*c* is a recessed groove (a constricted part) extending one round around an outer surface of the rod-shaped part 21, and is positioned below the convex part 21*b* (closer to the opening side of the large-diameter hole 14 of the first pin 10 than the convex part 21*b*). The cylindrical part 54 of the waterproof elastic member 50 deformed by pressing the waterproof elastic member 50 to the convex part 21*b* extends into the concave part 21*c*.

The flange part 22 has a larger diameter than that of a through-hole 61 of the housing 60 and prevents the intermediate member 20 from pulling out from the housing 60 downward. The diameter of the flange part 22 is larger than the diameter of the large-diameter hole 14 of the first pin 10. In the present embodiment, the diameter of the flange part 22 is the same as the diameter of the large-diameter part 12. An upper surface of the flange part 22 is in contact with the lower end part the cylindrical part 54 of the waterproof elastic member 50. In a pressing step for pressing the rod-shaped part 21 into the small-diameter hole 13 of the first pin 10 (FIG. 2(B) to FIG. 2(C)), a location where the upper surface of the flange part 22 is exactly in contact with a lower surface of a first surface part 51 of the waterproof elastic member 50 is set as a lower dead center (an ending point) of stroke of the pressing. In FIG. 2(C), a gap between an upper end of the rod-shaped part 21 and a bottom of the small-diameter hole 13 of the first pin 10 serves to reliably prevent the rod-shaped part 21 from being in contact with the bottom of the small-diameter hole 13 in the middle of the stroke of pressing. The cylindrical part 23 extends downward from the flange part 22. The cylindrical part 23 accommodates the spring 30 and a large-diameter part 42 of the second pin 40 therein. A lower end part (opening) of the cylindrical part 23 is a locking part 23*a*. The locking part 23*a* is a portion of which diameter is reduced by sheet metal processing such as caulking processing, and prevents the second pin 40 from pulling out from the cylindrical part 23.

The spring 30 is a coil spring formed of general materials such as a piano wire or a stainless steel wire and is held in the cylindrical part 23 of the intermediate member 20. An upper end of the spring 30 abuts to a hole bottom (an upper end surface) on an inner side of the cylindrical part 23. A lower end of the spring 30 abuts to a base end surface (an inclined surface 43 described below) of the second pin 40. The spring 30 urges the first pin 10 and the intermediate member 20 in a direction in which the first pin 10 and the intermediate member 20 and the second pin 40 are separated from each other, and applies a contact force with the object to each of the first pin 10 and the second pin 40.

The second pin 40 is a conductive metallic body such as copper or a copper alloy, and a tip thereof becomes a contact part with an electrode 81 of a substrate 80 which is the other object (FIG. 5). The second pin 40 has a small-diameter part 41 and a large-diameter part 42, in order from a lower side (a tip side of the second pin 40). A step part (an upper surface of the large-diameter part 12) between the small-diameter part 41 and the large-diameter part 42 is engaged with (hooked to) the locking part 23*a* of the cylindrical part 23 of the intermediate member 20, and thus the second pin 40 is prevented from pulling out from the cylindrical part 23. A base end surface (an upper end surface) of the large-diameter part 42 is the inclined surface 43 inclined to a surface perpendicular to an axial direction of the second pin 40. The second pin 40 is tilted by applying a biasing force of the spring 30 to the inclined surface 43, the base end surface on the side surface of the large-diameter part 42 is pushed to the inner side of the cylindrical part 23 of the intermediate member 20, and thus the electrical connection between the second pin 40 and the intermediate member 20 is reliably performed.

Although not illustrated, surfaces of the first pin 10, the intermediate member 20, and the second pin 40 are respectively subjected to plating. The plating is, for example, gold plating or silver plating, and materials for plating the respective members may be the same with or different from each other. The plating on the surfaces of the intermediate member 20 and the second pin 40 may be thinner than the plating on the surface of the first pin 10. The reason thereof is as follows: the first pin 10 has a possibility of being wetted by water, and thus the plating needs to be thick; whereas by presenting in a space where waterproofing is secured, the intermediate member 20 and the second pin 40 has a significantly lower risk of being wetted by water than in a case of the first pin 10, and thus the plating does not need to be thick.

The waterproof elastic member 50 is, for example, rubber such as silicone rubber, is interposed between the first pin 10 and the intermediate member 20, and watertightly seals (watertightly blocks) a space between the first pin 10 and the intermediate member 20. Moreover, by self-standing properties thereof, the waterproof elastic member 50 also serves to maintain the position of the first pin 10 upward as illustrated in FIG. 1 in a non-used state (a state where the both tips of the first pin 10 and the second pin 40 are opened). The waterproof elastic member 50 has the first surface part 51, a side surface part 52, a second surface part 53, and a cylindrical part 54. The first surface part 51 is a surface through which the intermediate member 20 penetrates. Specifically, on an upper surface of the first surface part 51, the cylindrical parts 54 of the same number as the contact unit are provided to protrude, and the rod-shaped part 21 of the intermediate member 20 penetrates through an inner circumference (the through-hole 55 illustrated in FIG. 3) of the cylindrical parts 54.

Figure 2B:
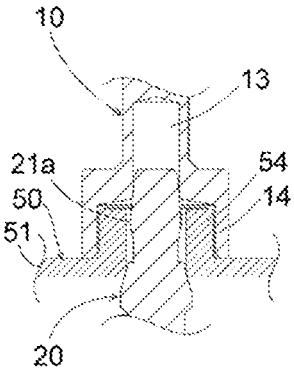
Figure 2C:
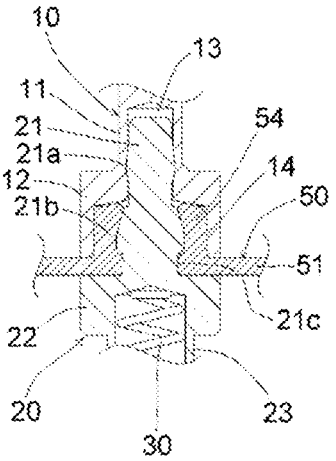

As illustrated in FIGS. 2(A) to 2(C), the cylindrical parts 54 is positioned in the large-diameter hole 14 of the first pin 10. The cylindrical parts 54 is interposed between the inner surface of the large-diameter hole 14 and the outer surface of the rod-shaped part 21 of the intermediate member 20 (that is, the cylindrical parts 54 is pressed over the entire circumference with respect to the inner surface of the large-diameter hole 14 by the convex part 21*b* of the rod-shaped part 21). The cylindrical parts 54 watertightly seals a space between the first pin 10 and the intermediate member 20. The cylindrical parts 54 is surrounded by the large-diameter hole 14 and the flange part 22. The cylindrical parts 54 deformed by pressing is released to the gap 14*a* in the large-diameter hole 14 of the first pin 10 illustrated in FIG. 2A, the inside of the concave part 21*c* of the intermediate member 20, and a space close to a side surface (a side surface of a portion having smaller diameter than the inner diameter of the cylindrical parts 54 in the non-compression state) of the upper part of the tapered part 21*d*. Thus, the deformation of the cylindrical parts 54 is prevented from being spread outward in the radial direction of the large-diameter hole 14.

The side surface part 52 extends downward from each side of the first surface part 51. When the first pin 10 is pushed by the electrode 91 of the terminal 90 which is mobile communication equipment and retreats in a direction being withdrawn into the cover 70 as illustrated in FIG. 5, by bending (elastically deforming) as illustrated in the same drawing, the side surface part 52 serves to secure a length of the stroke of the first pin 10. The second surface part 53 extends so as to be broadened from a lower end of the side surface part 52. The second surface part 53 is pressed to the upper surface of the housing 60 over the entire circumference surrounding the periphery of the through-hole 61 of the housing 60 by a convex part 73 provided in the cover 70, and watertightly seals a space between the convex part 73 and the upper surface of the housing 60.

Figure 3:
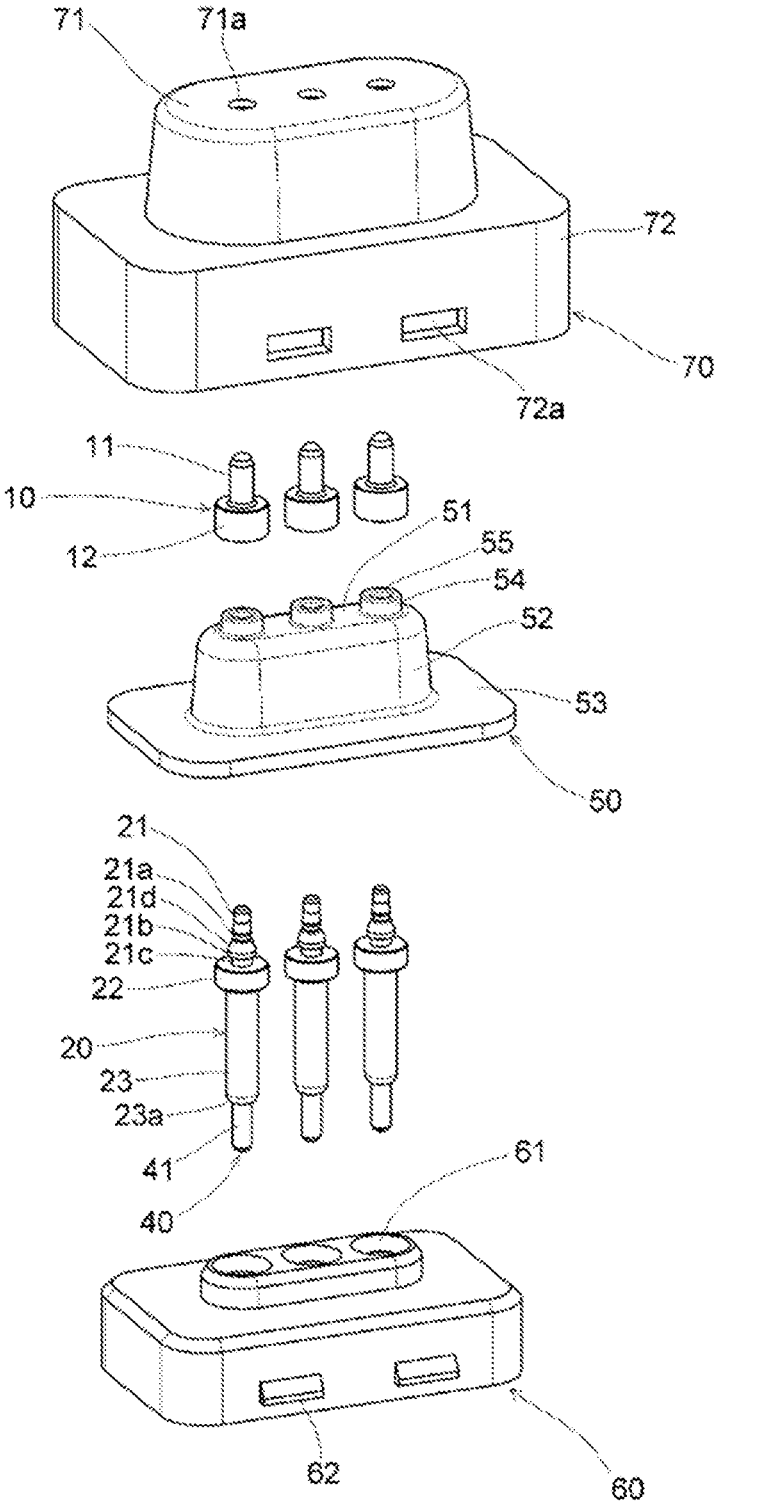
FIG. 3 is an exploded perspective view of the spring connector 1.
Figure 4:
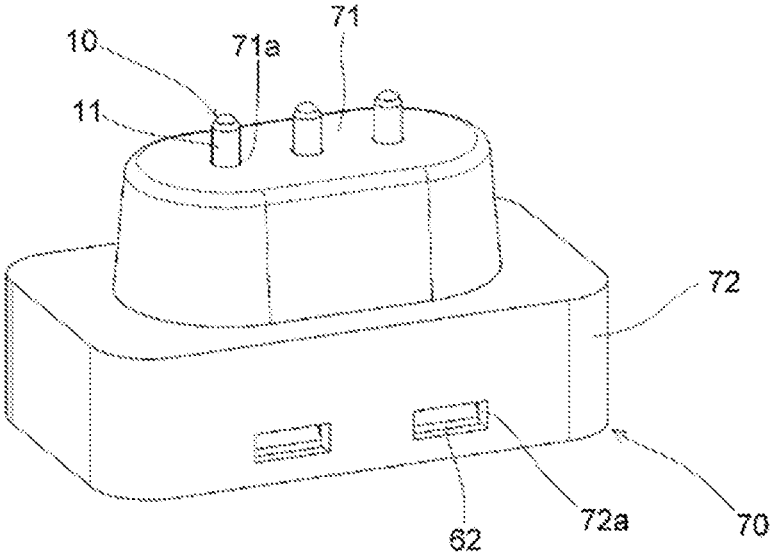
FIG. 4 is a perspective view of the spring connector 1.

The housing 60 is made of, for example, insulating resin and has the through-holes 61 of the same number as the contact unit. The through-hole 61 slidably accommodates the cylindrical part 23 of the intermediate member 20. As illustrated in FIG. 3, in a side wall part of the housing 60, a predetermined number of locking parts (locking convex parts) 62 for locking the cover 70 are provided. In addition to two locking pails 62 illustrated in FIG. 3, another two locking parts 62 are provided at a symmetrical position in a side wall part not illustrated in FIG. 3 on a side opposite to the side wall part in which the two locking parts 62 are provided.

The cover 70 is made of, for example, insulating resin and covers the housing 60 from above. A through-hole 71*a* through which the first pin 10 penetrates is provided in the ceiling part 71 of the cover 70. As illustrated in FIG. 3, a predetermined number of locking holes 72*a* for locking to the housing 60 are provided in a side wall part 72 of the cover 70. In addition to two locking holes 72*a* illustrated in FIG. 3, another two locking holes 72*a* are provided at a symmetrical position in a side wall part not illustrated in FIG. 3 on a side opposite to the side wall part in which the two locking holes 72*a* are provided among the side wall parts 72.

The housing 60 is covered with the cover 70 from above, and the cover 70 is locked (fixed) to the housing 60 by hooking (engaging) the locking part 62 of the housing 60 to the locking holes 72*a* of the cover 70. In this state, the convex part 73 provided on the inside of the cover 70 presses the second surface part 53 of the elastic member 50 with respect to the upper surface of the housing 60 over the entire circumference surrounding the periphery of the through-hole 61 of the housing 60. A space for allowing bending of the side surface part 52 of the waterproof elastic member 50 is provided between the housing 60 and the cover 70 (FIG. 5).

The flow of assembling the spring connector 1 will be described. First, the spring 30 and the large-diameter part 42 of the second pin 40 are accommodated in the cylindrical part 23 of the intermediate member 20, and the diameter of the lower end part of the cylindrical part 23 is reduced by sheet metal processing such as caulking processing to form the locking part 23*a*. Meanwhile, the first pins 10 are aligned and held in a state of being vertically inverted, and then the waterproof elastic member 50 vertically inverted is disposed such that the cylindrical parts 54 enters the large-diameter hole 14 of the first pin 10. Thereafter, the rod-shaped part 21 of the intermediate member 20 is pressed into the small-diameter hole 13 of the first pin 10 (FIG. 2(A) to FIG. 2(C)). A process of pressing-in is performed in a state of being vertically inverted, but FIGS. 2(A) to 2(C) are illustrated without being vertically inverted. FIG. 2(A) illustrates a state where the intermediate member 20 is aligned with the small-diameter hole 13. FIG. 2(9) illustrates a state where the intermediate member 20 is temporarily inserted into the small-diameter hole 13 only by the self-weight from the state of FIG. 2(A). In a case of only using the self-weight, as illustrated in FIG. 2(B), insertion is stopped at a position where the press-in part 21*a* of the intermediate member 20 is hooked to the lower end part of the small-diameter hole 13. At this time, the tapered part 21*d* of the convex part 21*b* does not press or only slightly presses an inner circumference of the through-hole 55 of the waterproof elastic member 50. FIG. 2(C) illustrates a state where the intermediate member 20 is pressed into by pressing or the like from the state of FIG. 2(B). The press-in part 21*a* is inserted into the small-diameter hole 13 until the upper end of the tapered part 21*d* of the convex part 21*b* is positioned in the vicinity of the small-diameter hole 13. By pressing-in, the convex part 21*b* of the intermediate member 20 completely enters into the large-diameter hole 14 of the first pin 10, and the cylindrical part 54 of the waterproof elastic member 50 is compressed between the convex part 21*b* and the inner surface of the large-diameter hole 14. At this time, the gap between the lower end of the large-diameter part 12 of the first pin 10 and the upper surface of the flange part 22 is a gap which does not interpose or only slightly interpose the first surface part 51. The concave part of the rod-shaped part 21 is positioned at a position corresponding to the gap. Subsequently, the housing 60 vertically inverted is disposed while inserting the second pin 40 into the through-hole 61. Finally, a state of being vertically inverted is returned to an original state, the cover 70 covers the housing 60 from above, and the locking part 62 of the housing 60 is engaged with the locking hole 72*a* of the cover 70. Accordingly, the second surface part 53 of the waterproof elastic member 50 is pressed to the upper surface of the housing 60 by the convex part 73 of the cover 70. Therefore, the spring connector 1 is completed.

As illustrated in FIG. 5, the spring connector 1 is held in a case 85 of a cradle for mobile communication equipment which is connection object equipment, for example, and is fixed onto the substrate 80 of the equipment. The substrate 80 and the case 85 are fixed to each other by fastening screw. Here, the second pin 40 is pushed by the electrode 81 of the substrate 80, and retreats in a direction being withdrawn while compressing the spring 30. The tip of the second pin 40 and the electrode 81 are contacted with each other by the biasing force of the spring 30. In addition, an annular waterproof elastic member 87 is pressed over the entire circumference by the case 85 and the cover 70, and watertightly seals a space between the case 85 and the cover 70.

The terminal 90 which is mobile communication equipment as an example of the object is set in the spring connector 1 in a state where the electrode 91 of the terminal 90 is aligned with the first pin 10. At this time, the first pin 10 is pushed by the electrode 91, and retreats in a direction being withdrawn while compressing the spring 30. The tip of the first pin 10 and the electrode 91 are contacted with each other by the biasing force of the spring 30. Accordingly, the electrode 81 of the substrate 80 and the electrode 91 of the terminal 90 are electrically connected to each other by the spring connector 1. The side surface part 52 of the waterproof elastic member 50 is bent in a space between the housing 60 and the cover 70.

According to the present embodiment, the following effects can be achieved.

(1) Since a configuration in which the waterproof elastic member 50 is interposed between the first pin 10 and the intermediate member 20 is adopted, it is possible to prevent the deformation of the waterproof elastic member 50 from being spread outward from the first pin 10 and the intermediate member 20, as compared with a case where the waterproof properties are secured by expanding the through-hole provided in the elastic member with a single part as in the conventional art.

(2) Since a configuration in which the cylindrical part 54 of the waterproof elastic member 50 is interposed (compressed) between the inner surface of the large-diameter hole 14 of the first pin 10 and the outer surface of the rod-shaped part 21 of the intermediate member 20 from a lateral direction is adopted, it is possible to prevent the deformation of the waterproof elastic member 50 from being spread outward from the first pin 10 and the intermediate member 20, as compared with a case where the waterproof elastic member 50 is interposed (compressed) from a vertical direction.

(3) Since the gap 14*a* in the large-diameter hole 14 of the first pin 10 illustrated in FIG. 2A, the inside of the concave part 21*c* of the intermediate member 20, and the space close to a side surface of the upper part of the tapered part 21*d* are a place for releasing the cylindrical parts 54 deformed by pressing is released, most of the deformation of the cylindrical part 54 can fall within the range of the inner diameter of the large-diameter hole 14 and it is possible to prevent the deformation of the waterproof elastic member 50 from being spread outward from the first pin 10 and the intermediate member 20.

(4) Since the deformation of the waterproof elastic member 50 is prevented from being spread outward from the first pin 10 and the intermediate member 20, positions of the first pin 10 and the second pin 40 to be a contact part or a distance between adjacent pins can be accurately determined as compared with the case in the conventional art. Moreover, since amounts of the first pins 10 protruded from the cover 70 are relatively uniform in a non-used state, reliability in appearance of the spring connector 1 is improved.

(5) Since a configuration in which the cylindrical parts 54 is pressed toward the inner surface of the large-diameter hole 14 by the convex part 21*b* of the rod-shaped part 21 is adopted and the tapered part 21*d* is provided in the convex part 21*b*, a risk of damaging the lower end part of the cylindrical part 54 by the convex part 21*b* when the rod-shaped part 21 is pressed into the small-diameter hole 13 of the first pin 10 (FIG. 2(B) to FIG. 2(C)) would be reduced.

(6) Since a configuration in which when the first pin 10 is pushed by the electrode 91 of the terminal 90 and retreats in a direction being withdrawn into the cover 70 as illustrated in FIG. 5, the side surface part 52 of the waterproof elastic member 50 is bent as illustrated in the same drawing is adopted, it is possible to secure the range allowing the stroke of the first pin 10 to be long, as compared with a case where the waterproof elastic member 50 does not have the side surface part 52.

(7) Since the plating on the surfaces of the intermediate member 20 and the second pin 40 present in a space where waterproofing is secured is made to be thinner than the plating on the surface of the first pin 10, the total amount of the plating can be controlled and it is advantageous for cost reduction. Specifically, in a case where the waterproof properties are secured by expanding the through-hole provided in the elastic member with a single part as in the conventional art, regarding to the part, the thick plating is necessary to apply to the entire surface including up to the portion (the portion where waterproofing is secured) on the lower side of elastic member, but in the present embodiment, the most or the entire of the thick plating is limited to only the surface of the first pin 10 present on the upper side (the space where waterproofing is not secured) of the waterproof elastic member 50, and thus the total amount of the plating can be controlled and it is advantageous for cost reduction as compared with the case in the conventional art. Moreover, since the plating on the surfaces of the intermediate member 20 and the second pin 40 is made to be thin, it is possible to accurately determine the inner diameter of the cylindrical part 23 of the intermediate member 20 and the outer diameter of the second pin 40 which require high dimensional accuracy.

Second Embodiment

Figure 6:
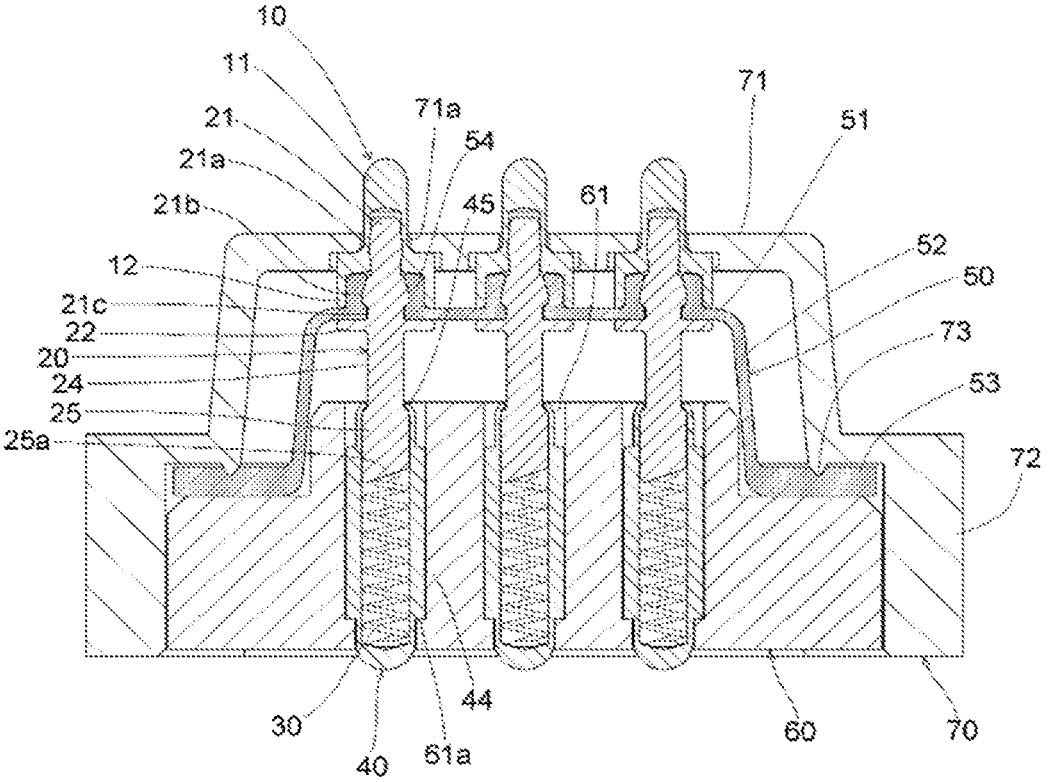
FIG. 6 is a cross-sectional view illustrating a state where a spring connector 2 according to a second embodiment of the present invention is not used.
Figure 7:
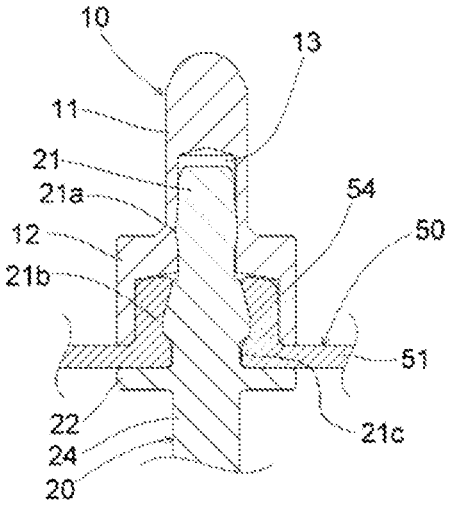
FIG. 7 is an enlarged view illustrating the vicinity of a cylindrical part 54 of a waterproof elastic member 50 in the spring connector 2 (a cover 70 is not illustrated).

With reference to FIGS. 6 and 7, a spring connector 2 according to a second embodiment of the present invention will be described while focusing on the differences from the first embodiment. In the spring connector 2, the intermediate member 20 has a small-diameter part 24 and a large-diameter part 25 from the flange part 22 toward the lower side, instead of the cylindrical part 23 illustrated in FIG. 1. A lower end surface of the large-diameter part 25 is the inclined surface 25*a* inclined to a surface perpendicular to an axial direction of the intermediate member 20. The second pin 40 is formed as a bottomed cylindrical shape and slidably accommodates the spring 30 and the large-diameter part 25 of the intermediate member 20 therein. The second pin 40 is prevented from pulling out from the housing 60 downward by engaging a large-diameter part 44 of the second pin 40 with a step part 61*a* of the through-hole 61 of the housing 60. The upper end part of the second pin 40 is a locking part 45 engaged with the large-diameter part 25 of the intermediate member 20. The locking part 45 is a portion of which diameter is reduced by sheet metal processing such as caulking processing, and prevents the intermediate member 20 from pulling out from the second pin 40. Other points in the present embodiment are the same as those of the first embodiment, The present embodiment can also achieve the same effects as those of the first embodiment.

Figure 8:
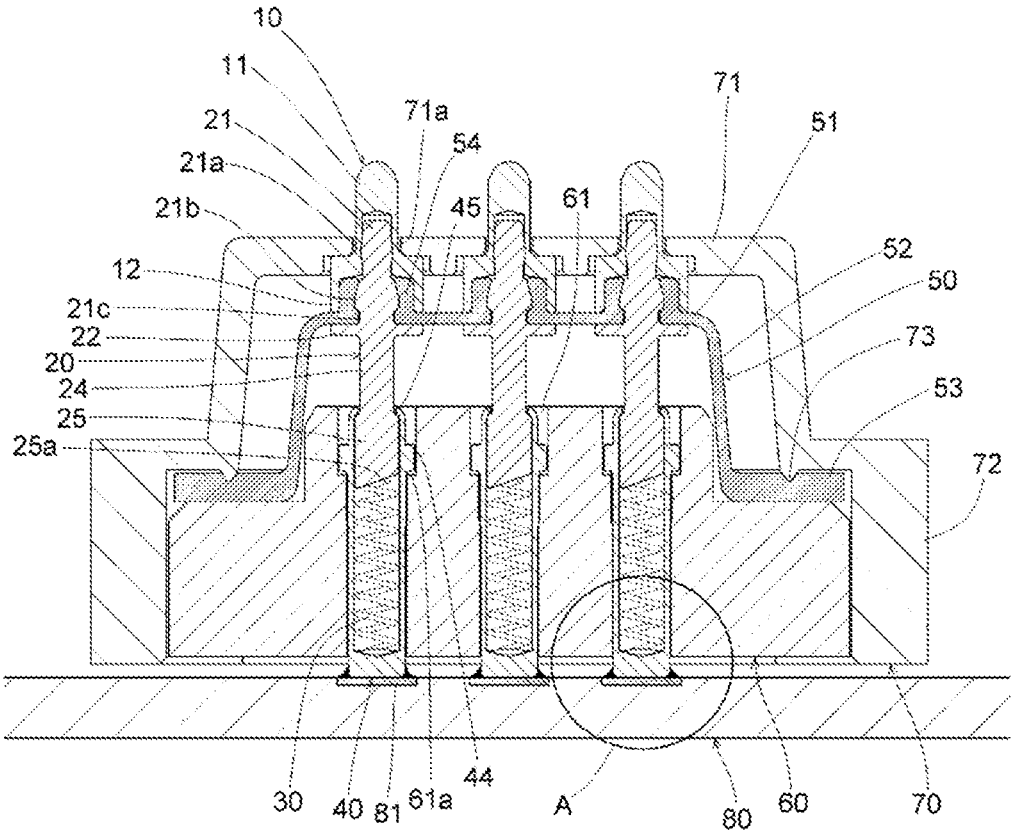
FIG. 8 is a cross-sectional view illustrating a modification example of the second embodiment.
Figure 9:
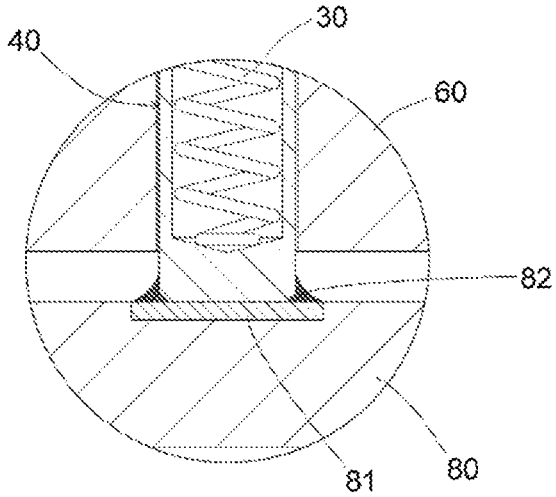
FIG. 9 is an enlarged view of an A part in FIG. 8.

FIG. 6 illustrates a case where a tip surface of the second pin 40 is a hemispherical surface, but the tip surface of the second pin 40 may be a flat surface such as a circular surface. FIGS. 8 and 9 illustrate a case where the tip surface of the second pin 40 is columnar, that is, the tip surface of the second pin 40 is a planar circular surface, and the tip surface is fixed to the electrode 81 on the substrate 80 of the connection object equipment by soldering (joined by a solder 82). In addition to that, the configuration of FIG. 8 is different from that of FIG. 6 in that the length of the large-diameter part 44 of the second pin 40 is short and the step part 61*a* of the through-hole 61 of the housing 60 is formed upward and the other points coincide with that of FIG. 6.

Third Embodiment

Figure 10:
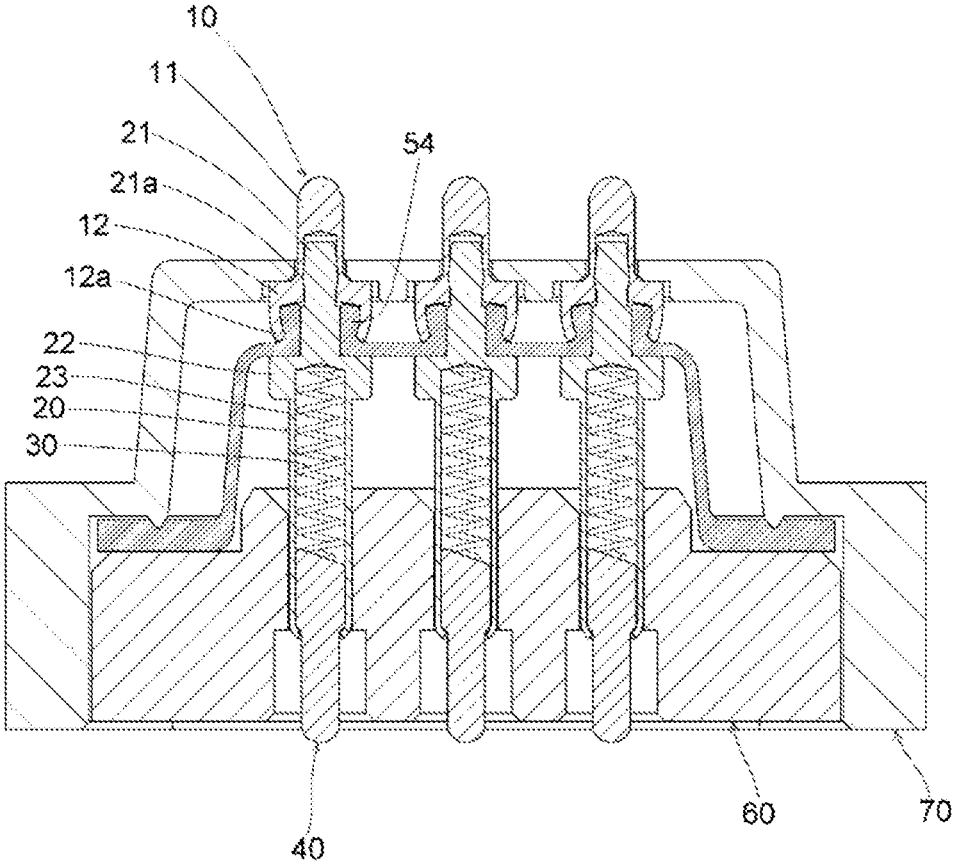
FIG. 10 is a cross-sectional view illustrating a state where a spring connector 3 according to a third embodiment of the present invention is not used.
Figure 11:
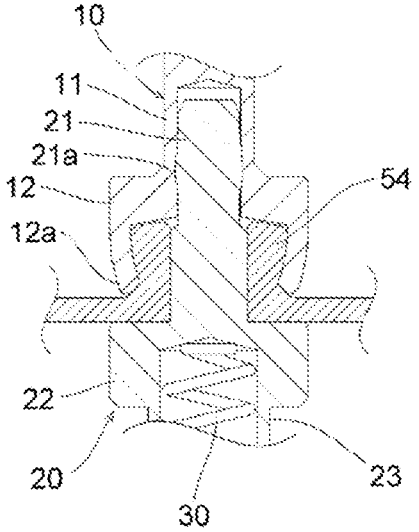
FIG. 11 is an enlarged view illustrating the vicinity of a cylindrical part 54 of a waterproof elastic member 50 in the spring connector 3 (a cover 70 is not illustrated).

With reference to FIGS. 10 and 11, a spring connector 3 according to a third embodiment of the present invention will be described while focusing on the differences from the first embodiment. In the spring connector 3, the rod-shaped part 21 of the intermediate member 20 does not have the convex part 21*b* and the concave part 21*c* illustrated in FIG. 1. Meanwhile, the lower end part of the large-diameter part 12 of the first pins 10 is a narrow part 12*a* of which diameter is reduced by sheet metal processing such as caulking processing, and presses the cylindrical part 54 of the waterproof elastic member 50 toward an outer surface of the rod-shaped part 21 of the intermediate member 20 by the narrow part 12*a*. The processing for forming the narrow part 12*a* is performed after the cylindrical part 54 of the waterproof elastic member 50 is disposed on an inside of the large-diameter part 12 of the first pin 10 and the intermediate member 20 is pressed into the first pins 10. Other points in the present embodiment are the same as those of the first embodiment. The present embodiment can also achieve the same effects as those of the first embodiment.

Fourth Embodiment

Figure 12:
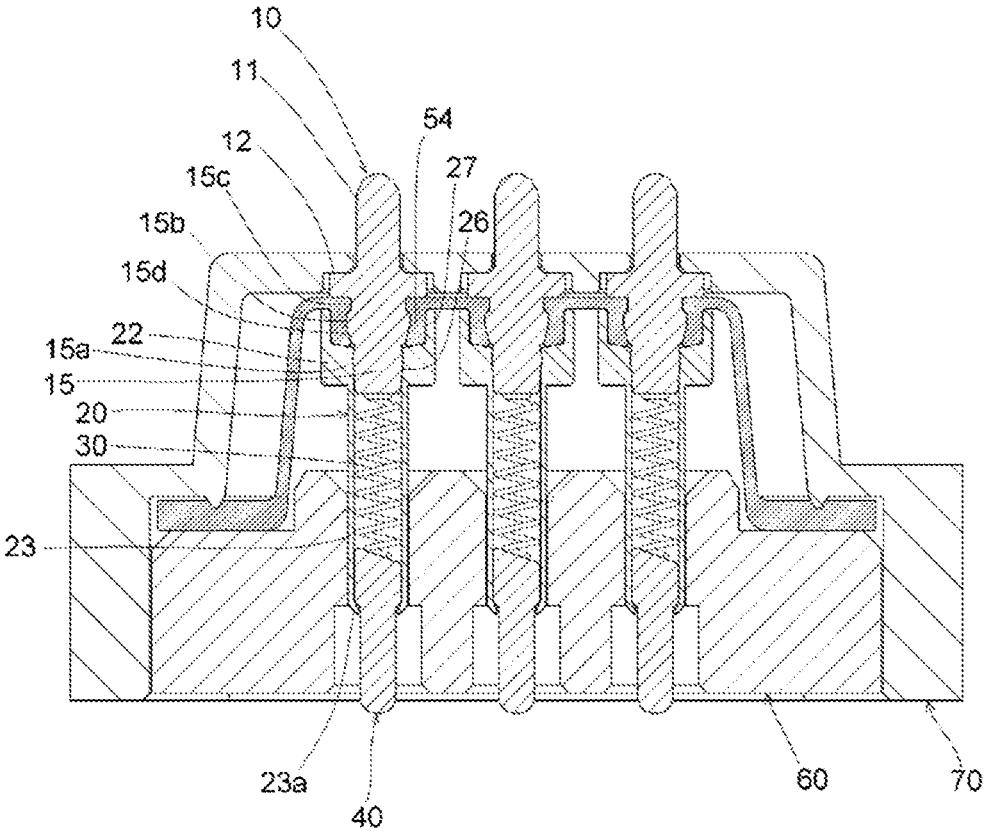
FIG. 12 is a cross-sectional view illustrating a state where a spring connector 4 according to a fourth embodiment of the present invention is not used.
Figure 13:
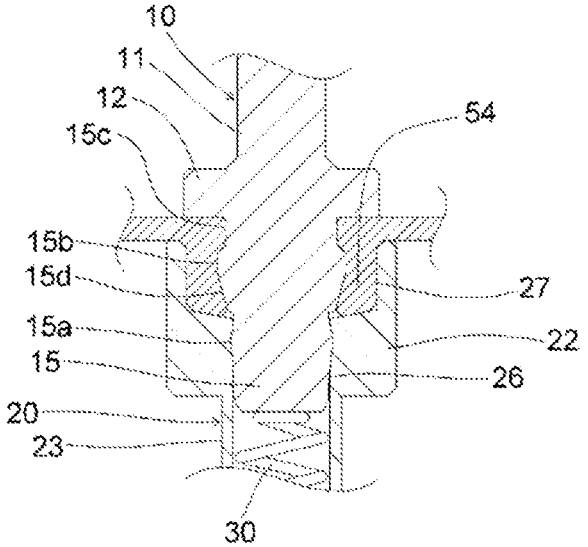
FIG. 13 is an enlarged view illustrating the vicinity of a cylindrical part 54 of a waterproof elastic member 50 in the spring connector 4 (a cover 70 is not illustrated).

With reference to FIGS. 12 and 13, a spring connector 4 according to a fourth embodiment of the present invention will be described while focusing on the differences from the first embodiment. The spring connector 4 has a configuration in which the first pins 10 is pressed into the intermediate member 20, and a function of holding the waterproof elastic member 50 is reversed to that of the first embodiment. The first pins 10 is non-hollow and has a rod-shaped part 15 extending downward from the large-diameter part 12. The rod-shaped part 15 has a press-in part 15*a*, a convex part 15*b*, and a concave pail 15*c*. The large-diameter part 12 and the rod-shaped part 15 function in the same manner as the flange part 22 and the rod-shaped part 21 in the first embodiment.

The press-in part 15*a* has a slightly larger diameter than an inner diameter of a small-diameter hole 26 of the intermediate member 20, and generates a holding force by pressing-in in a space between an inner surface of the small-diameter hole 26 and the press-in part 15*a*. The convex part 15*b* is a protruded strip (a pressing part) going around an outer surface of the rod-shaped part 15, and is positioned below the press-in part 15*a*. The convex part 15*b* presses the cylindrical part 54 of the waterproof elastic member 50 toward the inner side of a large-diameter hole 27 of the intermediate member 20. The convex part 15*b* has a tapered part 15*d* of which outer diameter becomes smaller toward a lower side (a bottom side of the large-diameter hole 27 of the intermediate member 20). In the tapered part 15*d*, an outer diameter of a lower part is smaller than the inner diameter of the cylindrical part 54 of the waterproof elastic member 50 in a non-compression state, and an outer diameter of an upper part is larger than the inner diameter of the cylindrical part 54. When the rod-shaped part 15 is pressed into the small-diameter hole 26 of the intermediate member 20, the tapered part 15*d* serves to cause the convex part 15*b* to be inserted into the through-hole 55 without damage of an upper end part of the cylindrical part 54 of the waterproof elastic member 50 by the convex part 15*b*. The concave part 15*c* is a recessed groove (a constricted part) going around an outer surface of the rod-shaped part 15, and is positioned above the convex part 15*b* (closer to the opening side of the large-diameter hole 27 of the intermediate member 20 than the convex part 15*b*). The cylindrical part 54 of the waterproof elastic member 50 deformed by pressing the waterproof elastic member 50 to the convex part 15*b* extends into the concave part 15*c*. In the first embodiment, the cylindrical part 54 of the waterproof elastic member 50 are provided so as to be protruded from the upper surface of the first surface part 51, but in the present embodiment, the cylindrical part 54 of the waterproof elastic member 50 are provided so as to be protruded from the lower surface of the first surface part 51.

The intermediate member 20 does not have the rod-shaped part 21 illustrated in FIG. 1, has the hollow flange part 22, and is a conductive tube formed into a cylindrical shape as a whole. The flange part 22 functions substantially in the same manner as the large-diameter part 12 in the first embodiment. The flange part 22 has the small-diameter hole 26 and the large-diameter hole 27 which are concentric with each other. The large-diameter hole 27 is opened to the upper end of the large-diameter part 12. The small-diameter hole 26 is opened to a central part on a lower surface of the large-diameter hole 27. The small-diameter hole 26 is a hole for pressing-in the rod-shaped part 15 of the first pin 10. The large-diameter hole 27 is a hole for accommodating the cylindrical part 54 of the waterproof elastic member 50. In the present embodiment, the locking part 23*a* at the lower end of the cylindrical part 23 of the intermediate member 20 can be formed from the beginning by cutting processing instead of posterior sheet metal processing. This is because, in a case of the present embodiment, a hole formed by the small-diameter hole 26 and the cylindrical part 23 vertically penetrates by communication between the small-diameter hole 26 and the cylindrical part 23, and thus the assembly can be sequentially performed in a manner that the first pin 10 is pressed into the intermediate member 20 from above after the second pin 40 and the spring 30 are inserted in order from above to the cylindrical part 23 of the intermediate member 20. Other points in the present embodiment are the same as those of the first embodiment. The present embodiment can also achieve the same effects as those of the first embodiment.

Fifth Embodiment

Figure 14:
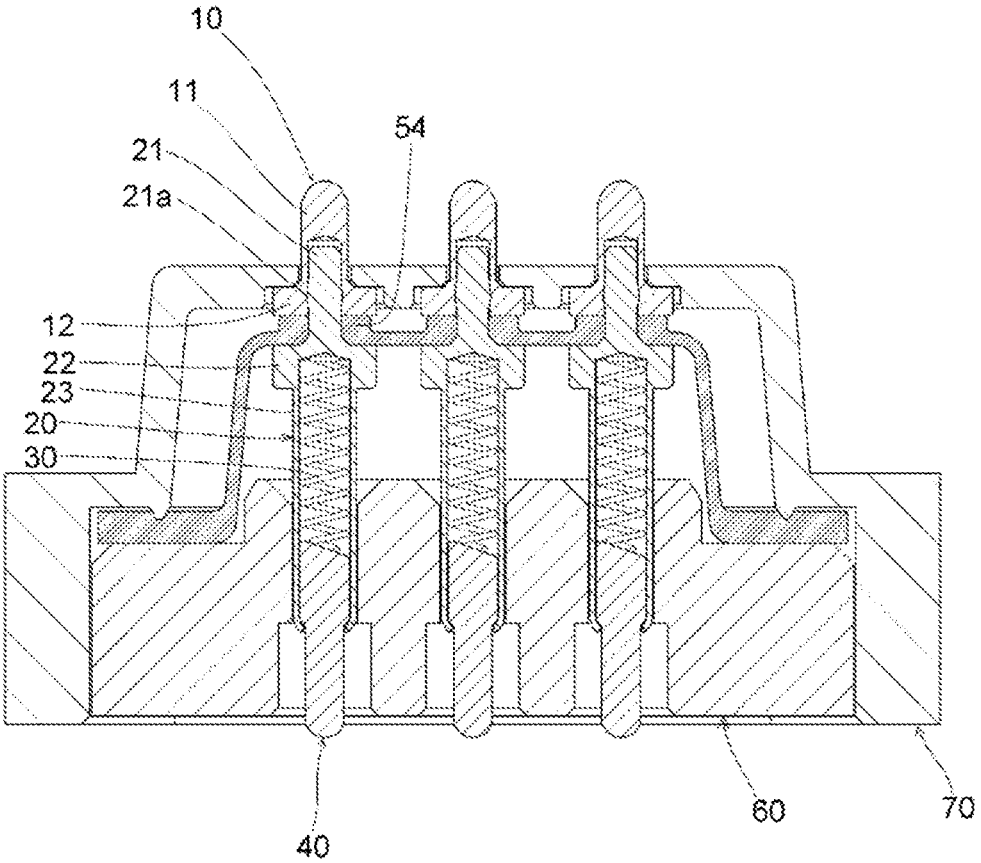
FIG. 14 is a cross-sectional view illustrating a state where a spring connector 5 according to a fifth embodiment of the present invention is not used.
Figure 15:
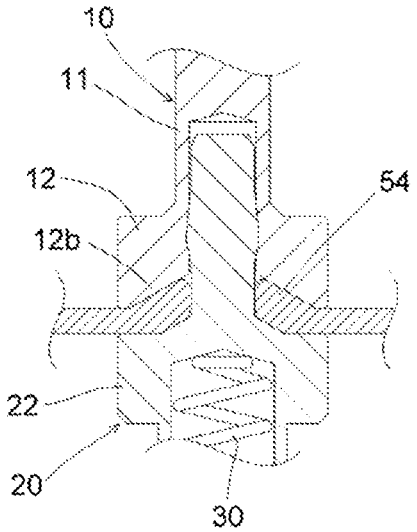
FIG. 15 is an enlarged view illustrating the vicinity of a cylindrical part 54 of a waterproof elastic member 50 in a case where a lower end surface of a large-diameter part 12 of a first pin 10 is inclined in the spring connector 5 (a cover 70 is not illustrated).

With reference to FIG. 14, a spring connector 5 according to a fifth embodiment of the present invention will be described while focusing on the differences from the first embodiment. The spring connector 5 has a configuration in which the cylindrical part 54 of the waterproof elastic member 50 is interposed between the first pin 10 and the intermediate member 20 from a vertical direction. The first pin 10 does not have the large-diameter hole 14 illustrated in FIG. 2A. The rod-shaped part 21 of the intermediate member 20 does not have the convex part 21*b* and the concave part 21*c* illustrated in FIG. 1. The cylindrical part 54 of the waterproof elastic member 50 is interposed (compressed) between the lower surface of the large-diameter part 12 of the first pin 10 and the upper surface of the flange part 22 of the intermediate member 20 from the vertical direction. The inner diameter of the cylindrical part 54 in a non-compression state is larger than the outer diameter of the rod-shaped part 21 of the intermediate member 20, and the cylindrical part 54 deformed by compression is released to a space close to the outer surface of the rod-shaped part 21. Other points in the present embodiment are the same as those of the first embodiment. In a case of the present embodiment, the deformation of the waterproof elastic member 50 is easily spread outward from the first pin 10 and the intermediate member 20 as compared with the first embodiment, but the deformation of the waterproof elastic member 50 can be prevented from being spread outward from the first pin 10 and the intermediate member 20 as compared with a case where the waterproof properties are secured by expanding the through-hole provided in the elastic member with a single part as in the conventional art. As illustrated in FIG. 15, in the spring connector 5, the lower surface of the large-diameter part 12 of the first pin 10 may be an inclined surface 12*b* formed obliquely upward as approaching to the inside. In this case, the deformation of the cylindrical part 54 of the waterproof elastic member 50 easily falls within the range of the outer diameter of the large-diameter part 12. The inclined surface may be provided in the flange part 22 of the intermediate member 20.

Sixth Embodiment

Figure 16:
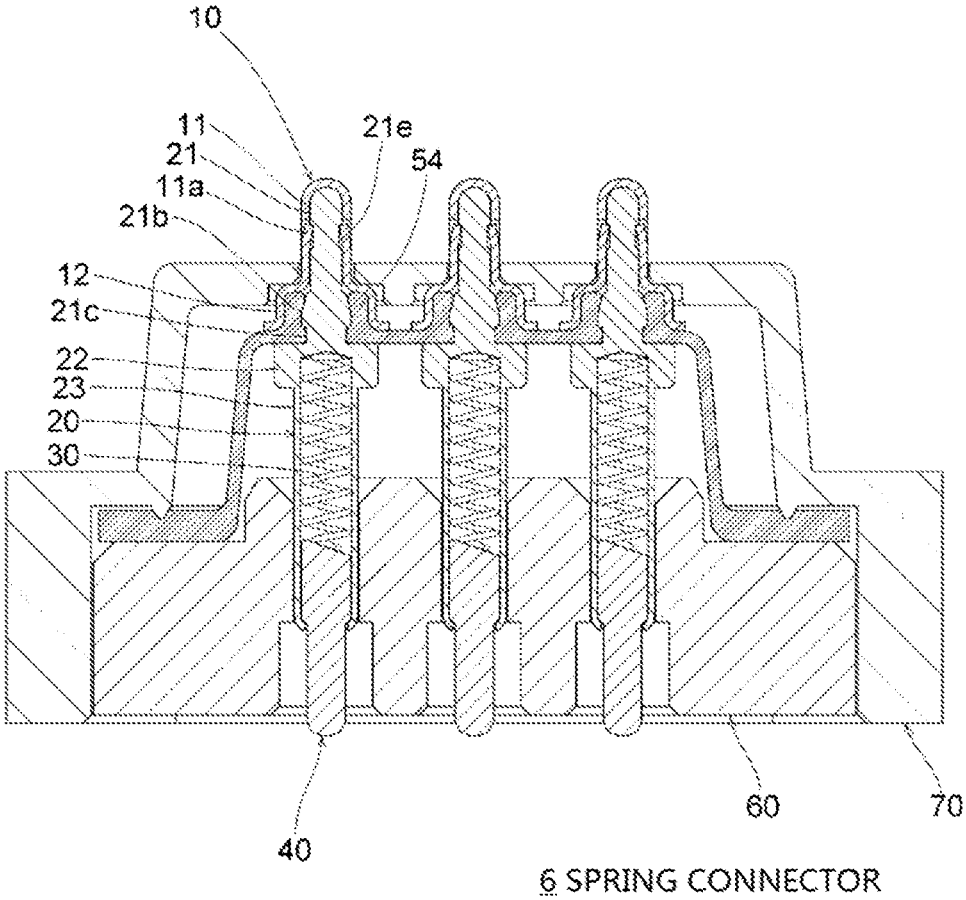
FIG. 16 is a cross-sectional view illustrating a state where a spring connector 6 according to a sixth embodiment of the present invention is not used.
Figure 17:
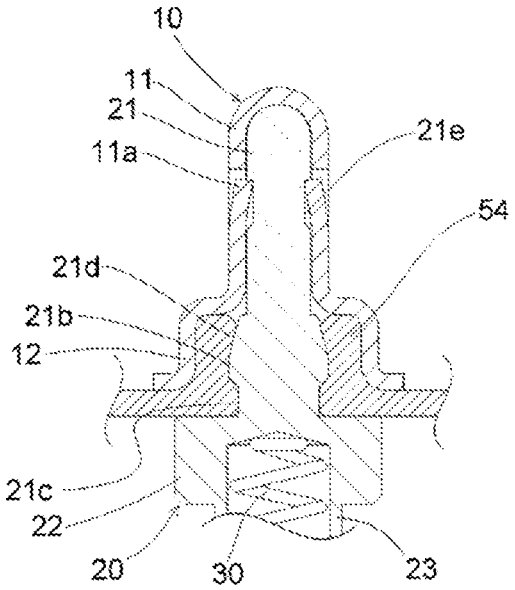
FIG. 17 is an enlarged view illustrating the vicinity of a cylindrical part 54 of a waterproof elastic member 50 in the spring connector 6 (a cover 70 is not illustrated).

With reference to FIGS. 16 and 17, a spring connector 6 according to a sixth embodiment of the present invention will be described while focusing on the differences from the first embodiment. The spring connector 6 has a configuration in which the first pin 10 and the intermediate member 20 are held each other by engagement of a leaf spring part 11*a* and a concave part 21*e*. The first pin 10 is a member made of a sheet metal and has a pair of leaf spring parts 11*a* on the side surface of the small-diameter part 11. The rod-shaped part 21 of the intermediate member 20 does not have the press-in part 21*a* illustrated in FIG. 1 and has a pair of concave parts 21*e* in the side surface. The leaf spring part 11*a* of the first pin 10 is engaged with the concave part 21*e* of the intermediate member 20. Specifically, a tip (an upper end part) of the leaf spring part 11*a* is in contact with an upper end wall part in the concave part 21*e*. In the state, the tip of the rod-shaped part 21 of the intermediate member 20 is in contact with the inside of the small-diameter part 11 of the first pin 10. Accordingly, the first pin 10 and the intermediate member 20 can be operated together (integrally). The lower end of the large-diameter part 12 of the first pin 10 extends in a flange shape so as not to damage the waterproof elastic member 50. Other points in the present embodiment are the same as those of the first embodiment. The present embodiment can also achieve the same effects as those of the first embodiment. According to the present embodiment, high-pressure pressing for pressing-in is not necessary, and thus a step of holding the intermediate member 20 in the first pin 10 is simple (a manual operation is also possible).

Hereinbefore, although the present invention has been described using the embodiments as an example, a person skilled in the art would understand that various modifications on constituent elements or operation processes of the embodiments can be made within a range not departing the scope of the claims. Hereinafter, a modification example will be described.

In the embodiments, it is described that the cylindrical part 54 of the waterproof elastic member 50 is interposed (compressed) from a lateral direction by the convex part 21*b* (FIG. 1, FIG. 2, and the like) provided in the intermediate member 20 or the narrow part 12*a* (FIGS. 10 and 11) provided in the first pins 10. The convex part may be provided in the cylindrical part 54 of the waterproof elastic member 50 without providing the convex part for pressing or the narrow pan in the intermediate member 20 or the first pins 10, and the convex part may be interposed (compressed) from a lateral direction between the intermediate member 20 and the first pins 10. Although the second pin 40 is in contact with the object in the embodiments, the second pin 40 may be omitted and the spring 30 may be in contact with the object.

REFERENCE SIGNS

1 to 6: spring connector
10: first pin
11: small-diameter part
11*a*: leaf spring part
12: large-diameter part
12*a*: narrow part
12*b*: inclined surface
13: small-diameter hole
14: large-diameter hole
14*a*: gap
15: rod-shaped part
15*a*: press-in part
15*b*: convex part (pressing part)
15*c*: concave part (constricted part)
20: intermediate member
21: rod-shaped part
21*a*: press-in part
21*b*: convex part (pressing part)
21*c*: concave part (constricted part)
21*d*: tapered part
21*e*: concave part
22: flange part
23: cylindrical part
23*a*: locking part
24: small-diameter part
25: large-diameter part
25*a*: inclined surface
26: small-diameter hole
27: large-diameter hole
30: spring
40: second pin
41: small-diameter part
42: large-diameter part
43: inclined surface
44: large-diameter part
45: locking part
50: waterproof elastic member
51: first surface part
52: side surface part
53: second surface part
54: cylindrical part
55: through-hole
60: housing
61: through-hole
61*a*: step part
62: locking part (locking convex part)
70: cover
71: ceiling pail
71*a*: through-hole
72: side wall part
72*a*: locking hole
73: convex part
80: substrate
81: electrode
82: solder
85: case
87: waterproof elastic member
90: terminal
91: electrode

The invention claimed is:

1. A spring connector, comprising:

a first pin including a contact part with an object;

a spring that applies a contact force with the object to the first pin;

an intermediate member electrically connected to the first pin and fixed to the first pin; and a waterproof elastic member that is interposed between the first pin and the intermediate member and water-tightly seals a space between the first pin and the intermediate member.

2. The spring connector according to claim 1, further comprising:

a second pin having a contact part with another object, wherein the spring urges the first pin and the second pin in a direction in which the first pin and second pins are separated from each other, and wherein the intermediate member is a tube for accommodating the spring, a part of the first pin, and a part of the second pin.

3. The spring connector according to claim 1, wherein one of the first pin and the intermediate member has a hole opening to a side of the other of the first pin and the intermediate member, and wherein the other of the first pin and the intermediate member has a rod-shaped part pressed into the hole.

4. The spring connector according to claim 1, wherein the first pin is a member made of a sheet metal and has a leaf spring part, and wherein the intermediate member has a concave part engaged with the leaf spring part.

5. The spring connector according to claim 1, wherein surfaces of the first pin and the intermediate member are respectively subjected to plating, and wherein the plating on the surface of the intermediate member is thinner than the plating on the surface of the first pin.

6. The spring connector according to claim 1, wherein the waterproof elastic member has a first surface part through which the first pin or the intermediate member penetrates, and a side surface part extending from the first surface part to a side opposite to a tip of the first pin.

7. The spring connector according to claim 6, further comprising:

a housing having a through-hole that accommodates at least a part of either one or both of the spring and the intermediate member; and a cover covering the housing and having a through-hole through which the first pin penetrates, wherein a space is present between the housing and the cover, and the side surface part of the waterproof elastic member is capable of bending within the space.

8. The spring connector according to claims 7, wherein the waterproof elastic member has a second surface part extending to be broadened from the side surface part in a position on a side opposite to the first surface part, and wherein the second surface part is pressed by the housing and the cover over an entire circumference surrounding a periphery of the through-hole of the housing.

9. The spring connector according to claim 1, wherein one of the first pin and the intermediate member has a hole opening to a side of the other of the first pin and the intermediate member, wherein the other of the first pin and the intermediate member has a rod-shaped part extending into the hole, wherein the waterproof elastic member has a cylindrical part positioned in the hole, and wherein the cylindrical part is interposed between an inner surface of the hole and an outer surface of the rod-shaped part.

10. The spring connector according to claim 9, wherein the hole has a narrow part that is narrowed in an external dimension and presses the waterproof elastic member.

11. The spring connector according to claim 9, wherein the rod-shaped part has a convex part which is provided on the outer surface of the rod-shaped part and presses the waterproof elastic member.

12. The spring connector according to claim 11, wherein the convex part has a tapered part having an outer diameter which becomes smaller toward a bottom side of the hole.

13. The spring connector according to claim 11, wherein the rod-shaped part has a concave part provided in the outer surface of the rod-shaped part at a position closer to an opening side of the hole than the convex part, and wherein a part of the waterproof elastic member deformed by being pressed by the convex part extends into the concave part.

* * * * *